US007024825B2

(12) United States Patent
Kebeli

(10) Patent No.: US 7,024,825 B2
(45) Date of Patent: Apr. 11, 2006

(54) BRACKET FOR CONNECTING ROOF RAFTERS TO CORRUGATED BIN SIDEWALLS

(75) Inventor: Hasan Volkan Kebeli, Mason City, IA (US)

(73) Assignee: Sukup Manufacturing Company, Sheffield, IA (US)

( * ) Notice: Subject to any disclaimer, the term of this patent is extended or adjusted under 35 U.S.C. 154(b) by 315 days.

(21) Appl. No.: 10/682,175

(22) Filed: Oct. 9, 2003

(65) Prior Publication Data

US 2005/0076592 A1 Apr. 14, 2005

(51) Int. Cl.
*H04B 7/04* (2006.01)

(52) U.S. Cl. ..... 52/93.1; 52/92.2; 52/712

(58) Field of Classification Search ..... 52/712, 52/714, 92.2, 92.3, 82, 192; 248/200, 300, 248/235, 250; 403/408.1
See application file for complete search history.

(56) References Cited

U.S. PATENT DOCUMENTS 1,336,945 A * 4/1920 Dickelman ..... 454/175

OTHER PUBLICATIONS

Brochure by Behlen.
Brochure by GSI.
Brochure by Westeel.

* cited by examiner

*Primary Examiner*—Carl D. Friedman
*Assistant Examiner*—Tiara Robertson

(57) ABSTRACT

An attachment bracket for securing a rafter to a sidewall in a bin having horizontal sidewall corrugations has a bracket having first and second attachment portions at right angles to each other. The first portion has a plurality of parallel horizontal corrugation adapted to nest in the parallel horizontal corrugations in an upper portion of a bin sidewall. The second portion extends upwardly and inwardly from the first portion to be secured to the lower end of an inclined rafter that supports a conical shaped roof for the bin.

3 Claims, 8 Drawing Sheets

BRACKET FOR CONNECTING ROOF RAFTERS TO CORRUGATED BIN SIDEWALLS

BACKGROUND OF THE INVENTION

Inclined rafters are commonly used to support conical-shaped roof panels on the upper edge of a circular grain bin wall. A variety of brackets have been used to interconnect the wall to the rafters. Existing brackets are complicated in construction, often difficult to install, and do not efficiently transfer loads from rafters to columns or sidewalls without creating additional bearing stresses.

It is therefore a principal object of this invention to provide a bracket for connecting roof rafters to corrugated bin sidewalls that will efficiently transfer loads from rafters to columns and sidewalls without creating any additional bearing stresses.

A further object of this invention is to provide a bracket for connecting roof rafters to corrugated bin sidewalls that is easy to install, and economical to manufacture.

These and other objects will be apparent to those skilled in the art.

SUMMARY OF THE INVENTION

An attachment bracket for securing a rafter to a sidewall in a bin having horizontal sidewall corrugations has a bracket having first and second attachment portions at right angles to each other. The first portion has a plurality of parallel horizontal corrugations adapted to nest in the parallel horizontal corrugations in an upper portion of a bin sidewall. The second portion extends upwardly and inwardly from the first portion to be secured to the lower end of an inclined rafter that supports a conical shaped roof for the bin.

DESCRIPTION OF THE PREFERRED EMBODIMENT

Figure 1:
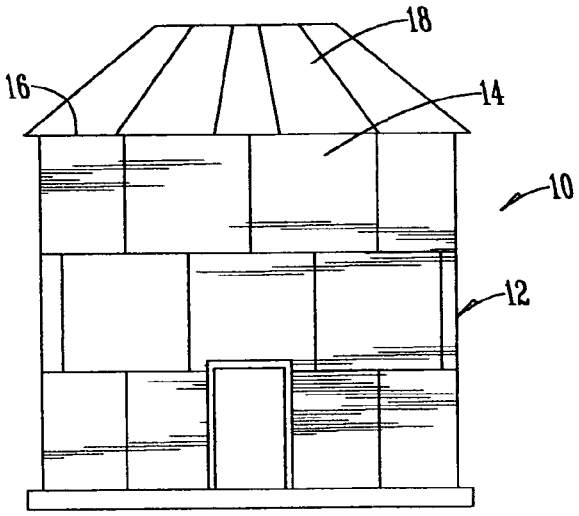
FIG. 1 is a side elevational view of a grain bin of this invention.
Figure 2:
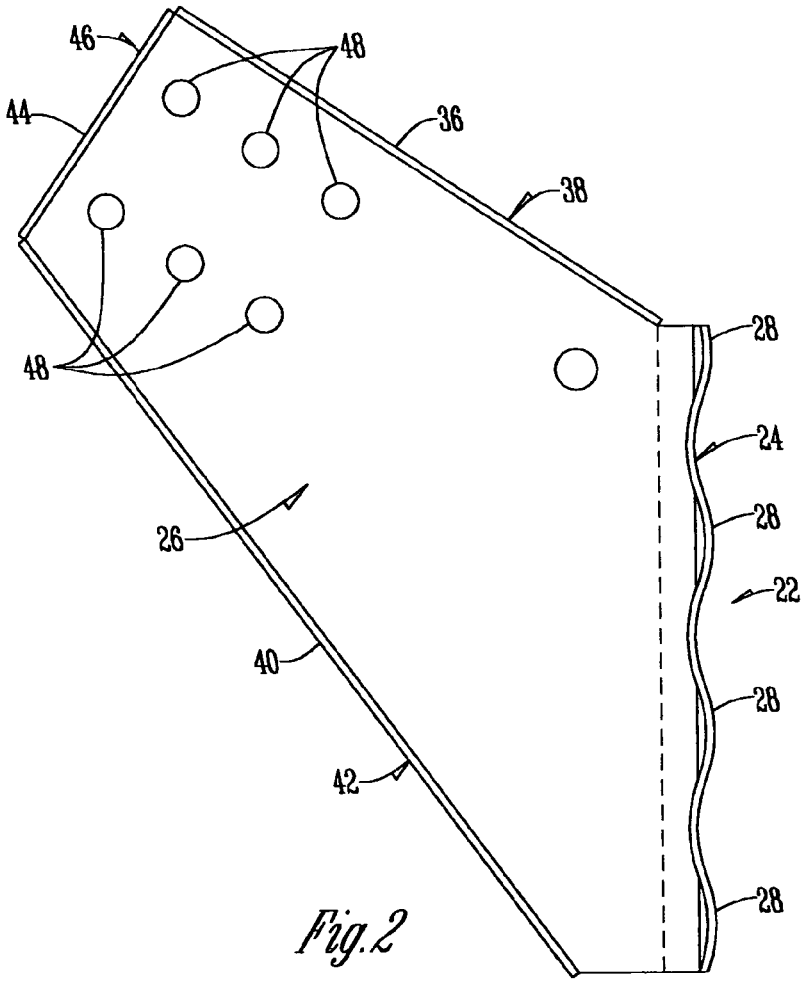
FIG. 2 is a plan view of the bracket of the invention showing primarily the second portion of the bracket of this invention that is secured to the rafter.
Figure 3:
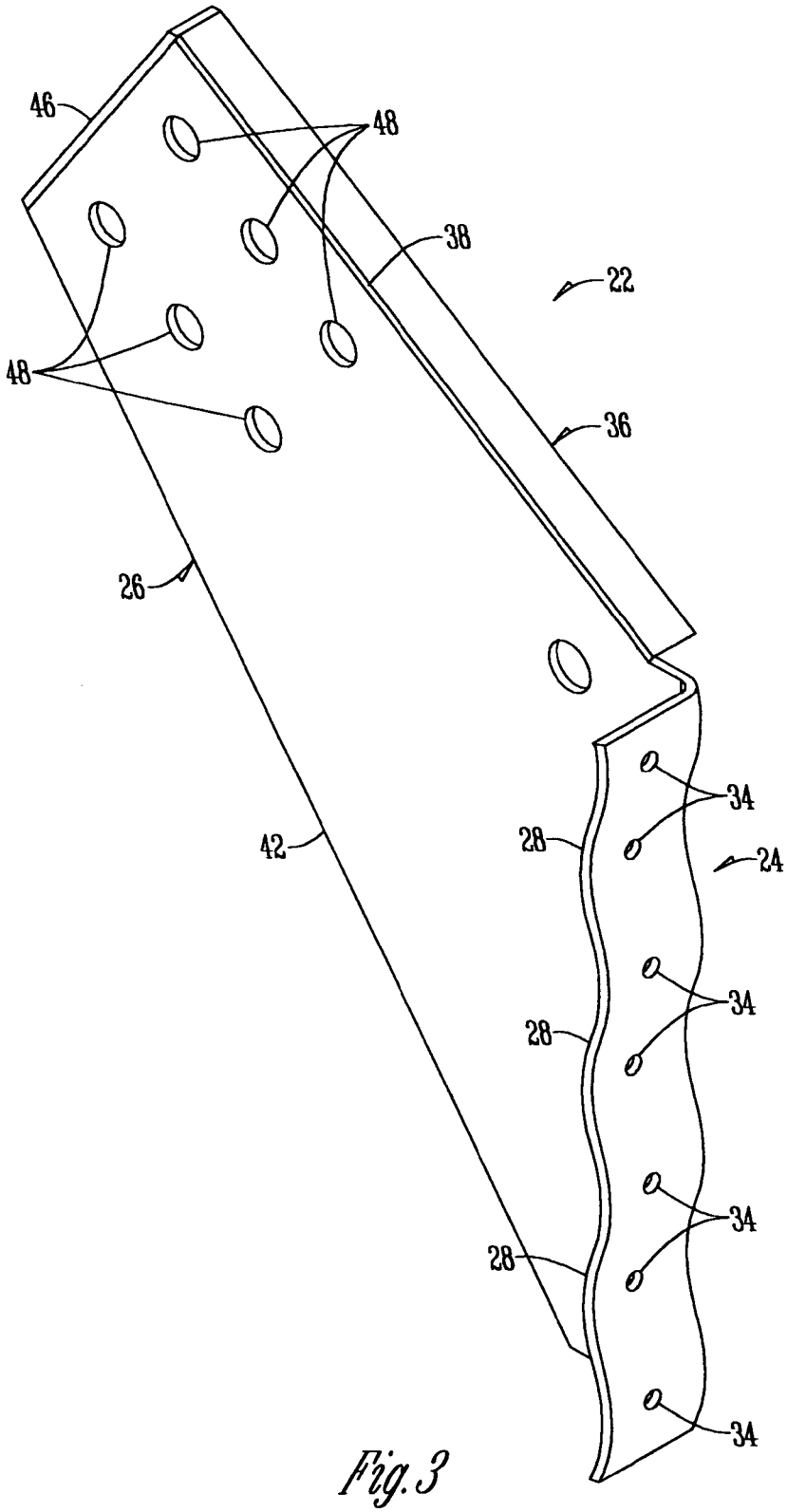
FIG. 3 is a perspective view of the bracket of FIG. 2 showing the surface of the bracket that nests in the corrugations of the bin wall.
Figure 4:
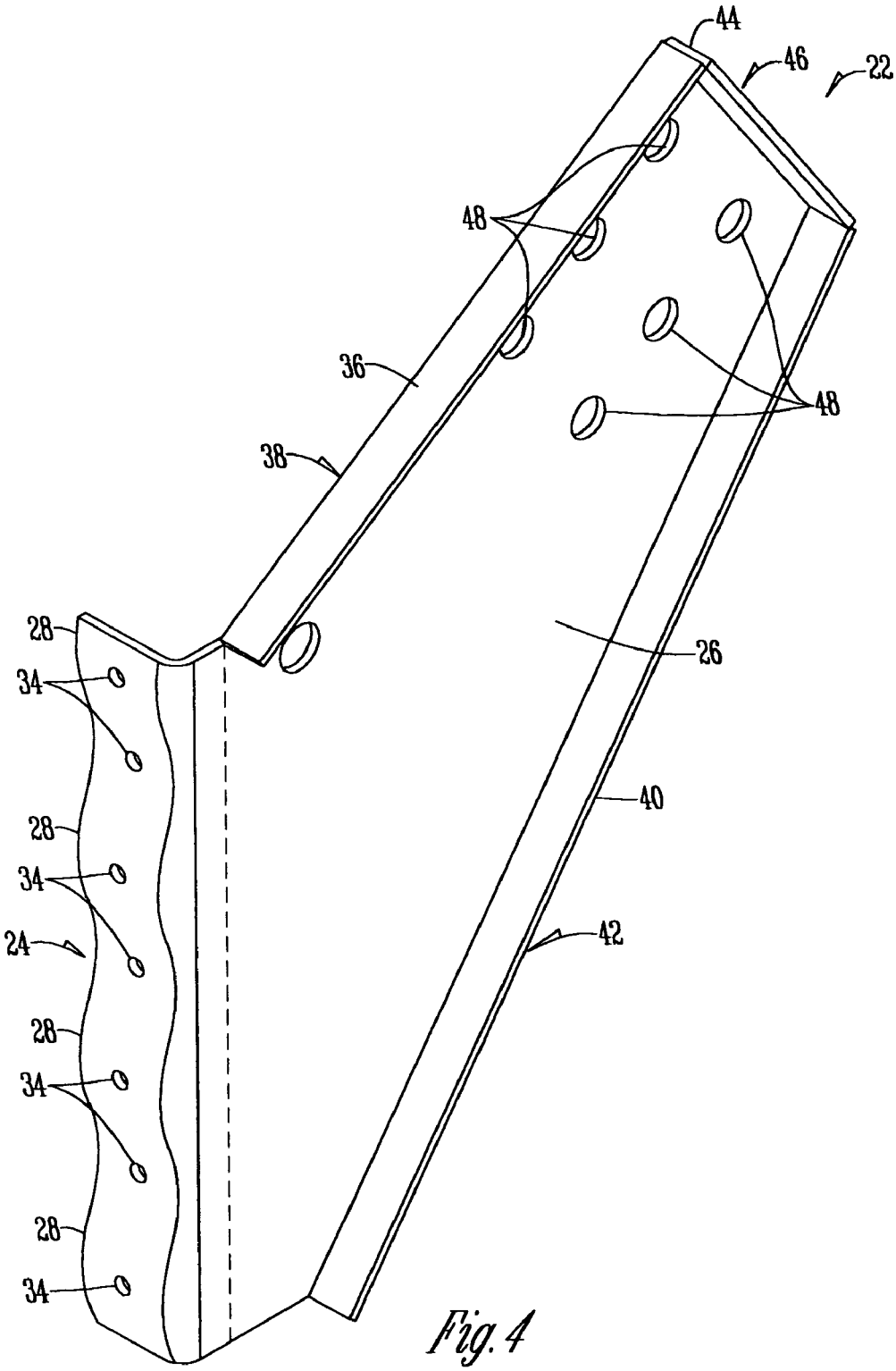
FIG. 4 is a perspective view of the bracket showing the surface of the bracket opposite to that of FIG. 3.

As shown in FIG. 1, the conventional grain bin 10 has a vertical sidewall 12 having an upper portion 14 and upper edge 16. A conical roof 18 is positioned on the top of the bin 10 and is supported by rafters 20 shown in part in FIG. 5.

Figure 5:
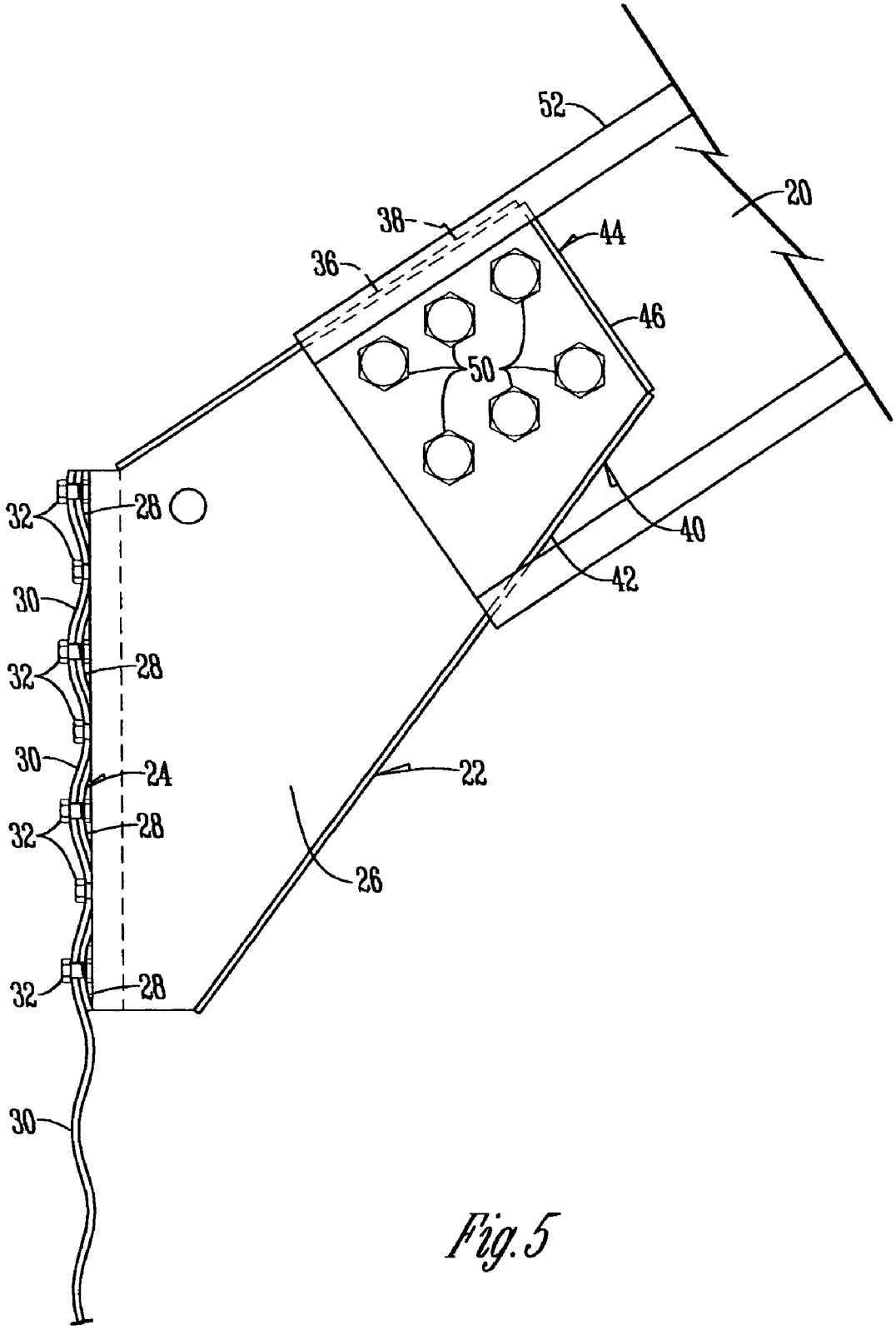
FIG. 5 is a sectional side view through an upper edge of a bin wall showing how the bracket of this invention connects the wall to the lower end of a rafter.
Figure 5A:
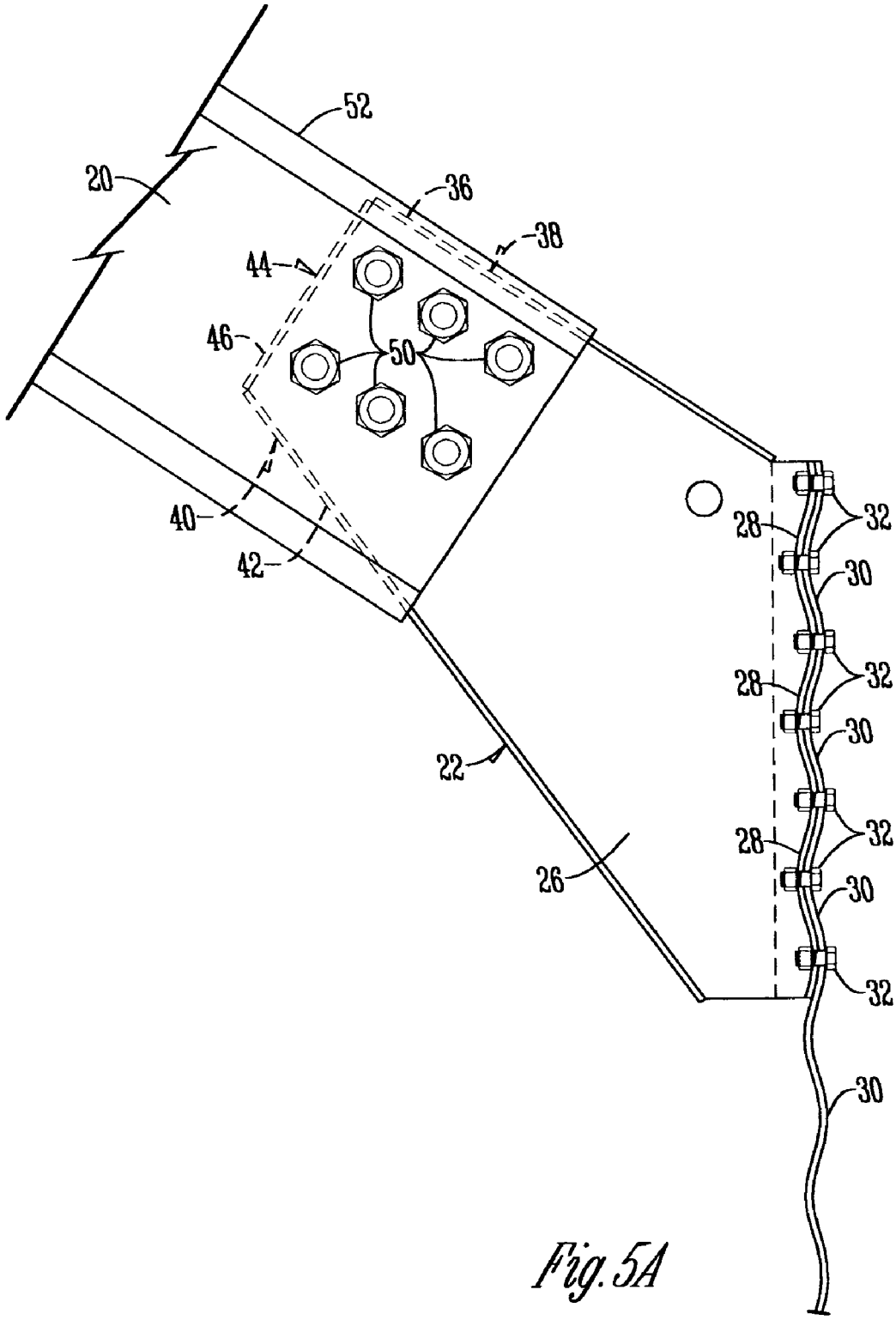
FIG. 5A is a sectional side view through an upper edge of the bin wall and the bracket showing the surface of the bracket opposite to that of FIG. 5.
Figure 6:
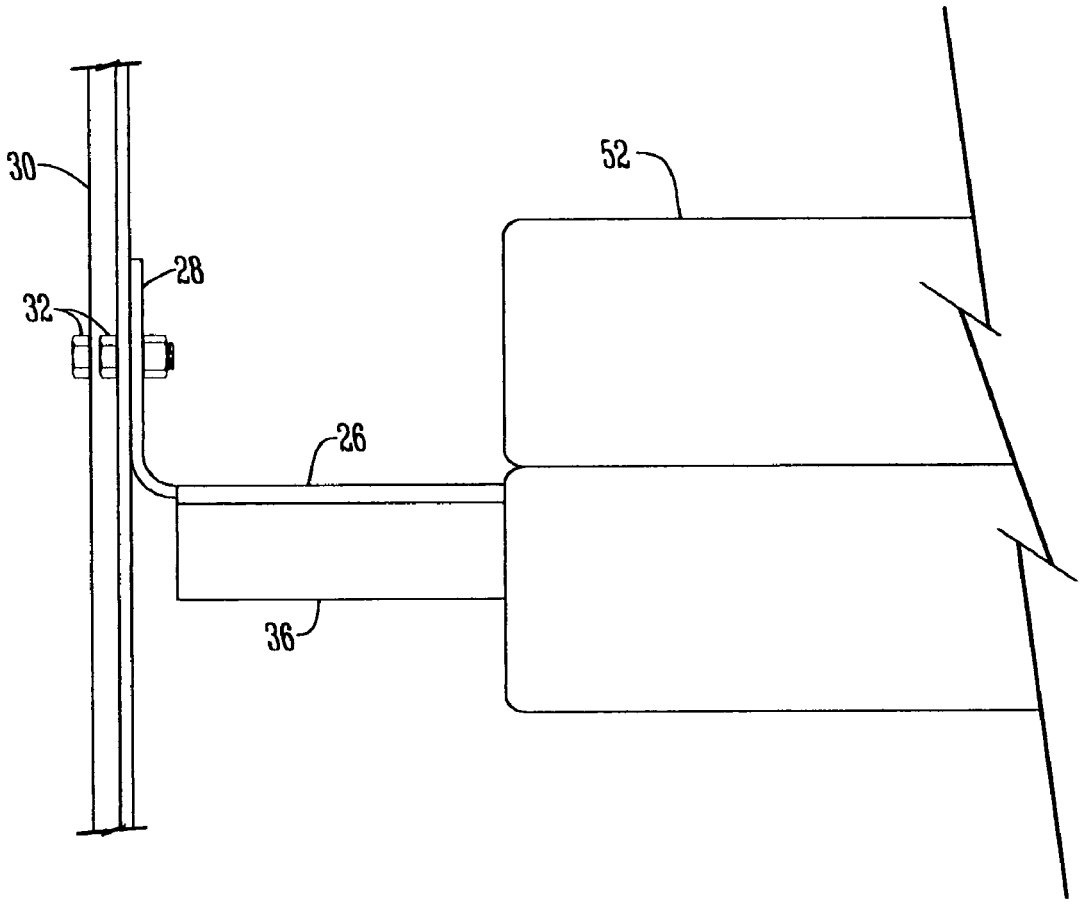
FIG. 6 is a sectional bottom view through an upper edge of the bin wall and the bracket showing the bottom side of the bracket of FIG. 5.
Figure 7:
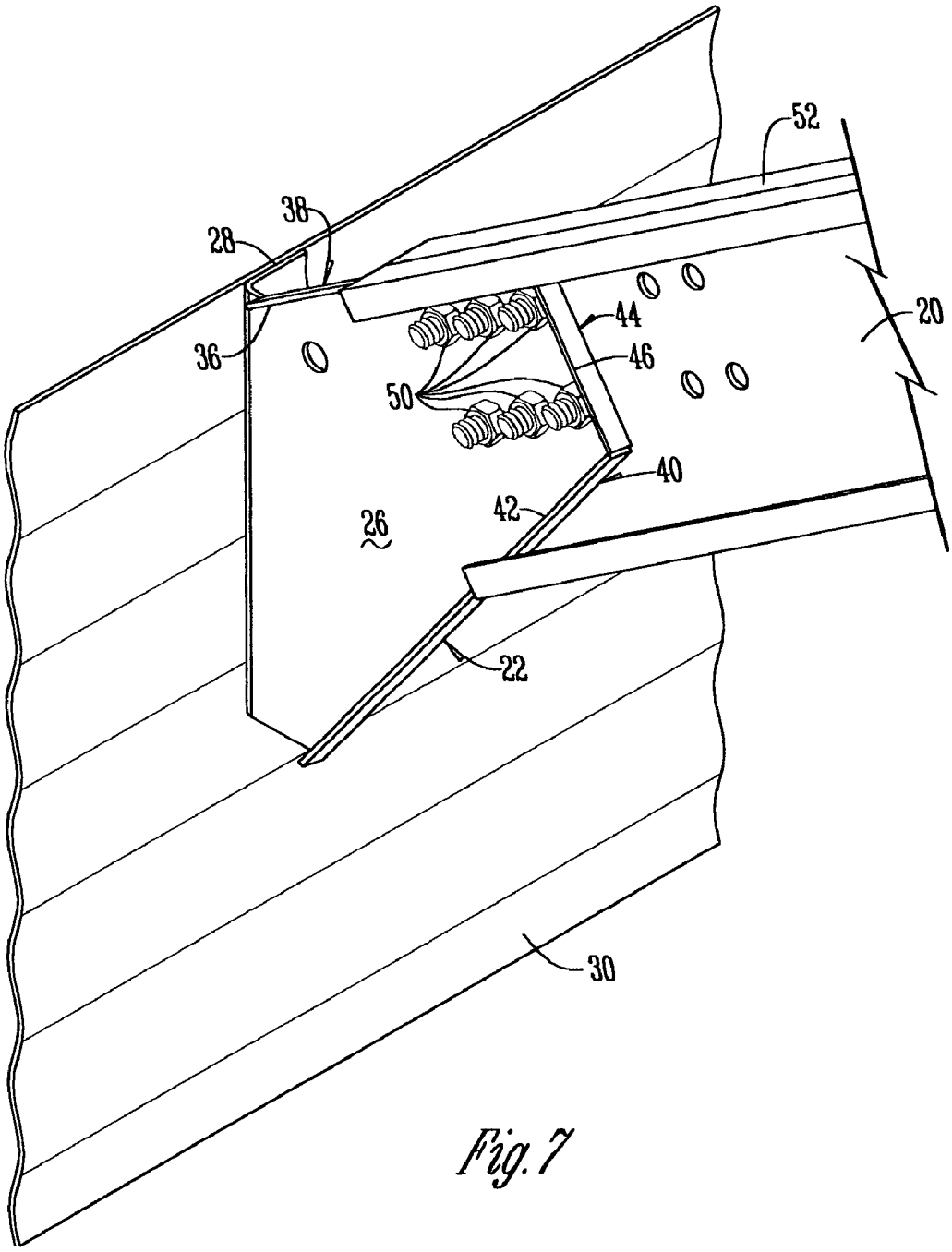
FIG. 7 is a perspective view of the bracket and bin wall showing the bracket nesting in the corrugations of the bin wall.
Figure 7A:
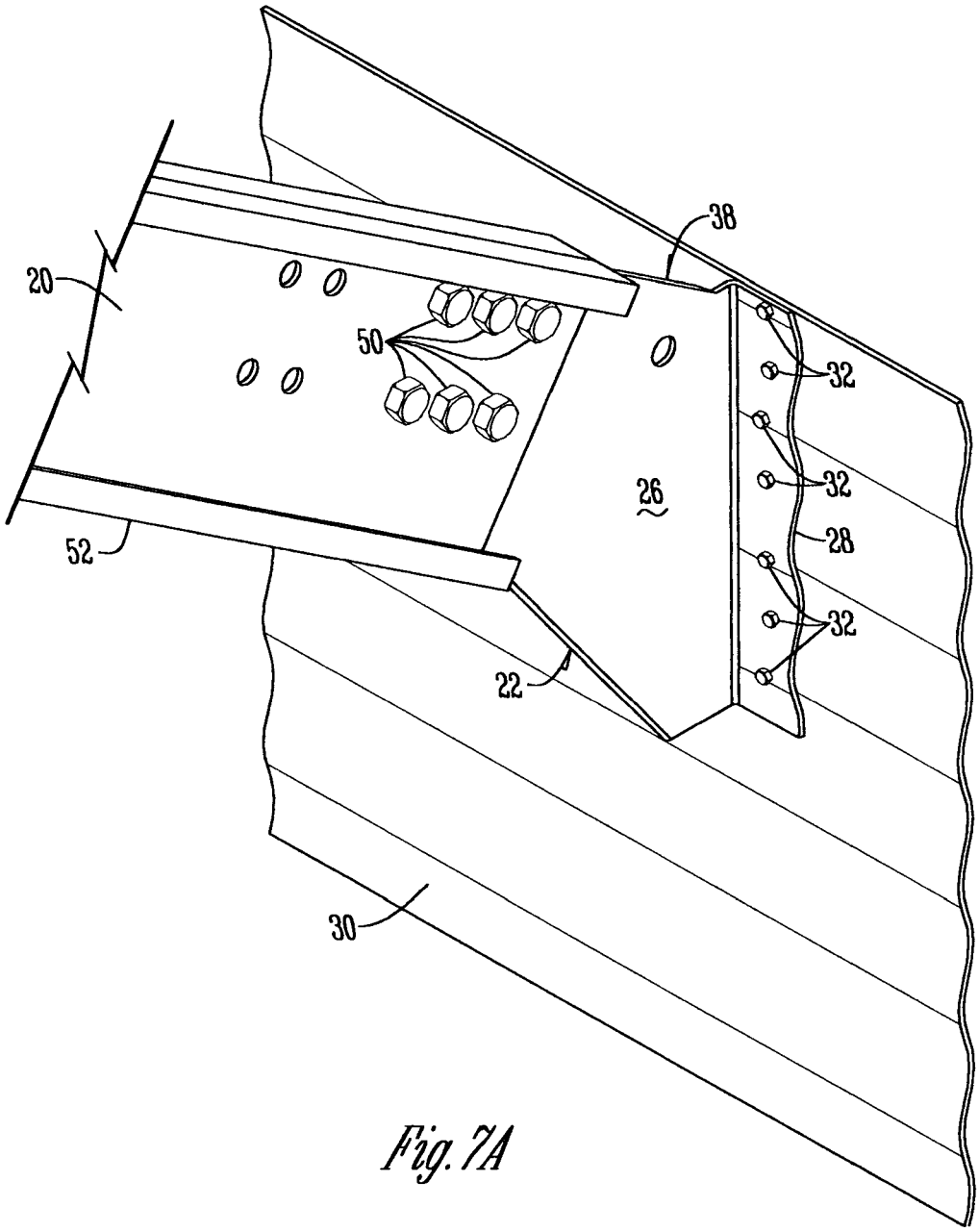
FIG. 7A is a perspective view of the bracket and bin wall showing the bracket nesting in the corrugations of the bin wall, showing the surface of the bracket opposite to that of FIG. 7.

With reference to FIGS. 2 through 5, a bracket 42 has a first portion 24 and a second portion 26 formed at right angles to the first portion and extending upwardly and inwardly therefrom. The first portion 24 normally dwells in a vertical plane and has corrugations 28 that nest in the corrugations 30 of the sidewall 12 (FIG. 5). Bolts 32 extend through holes 34 to secure the first portion of the bracket 22 to the sidewall 12.

A flange 36 is formed on an upper edge 38 of the second portion 26. A flange 40 extends at right angles from the lower edge 42 of the second portion. Similarly, a flange 44 extends at right angles from the first portion along the inner end 46 thereof.

A plurality of holes 48 appear in the second portion 26 and receive bolts 50 (FIG. 5) to secure the bracket 22 to the lower end of rafter 20.

It should be noted in FIG. 5 that the flange 36 on the upper edge 38 of the second portion 26 of bracket 22 nests within the flange 52 of the rafter 20.

It is therefore seen that the bracket 22 of this invention helps to transfer any loads imposed on rafters 20 to the sidewall 12 without creating any additional bearing stresses. This invention thereof achieves its stated objectives.

I claim:

1. An attachment bracket for securing a rafter to a sidewall in a bin having horizontal sidewall corrugations, comprising:

a bracket having first and second attachment portions at right angles to each other, the first portion having a plurality of parallel horizontal corrugations adapted to nest in the parallel horizontal corrugations in an upper portion of a bin sidewall, the second portion extending upwardly and inwardly from the first portion to be secured to the lower end of an inclined rafter that supports a conical shaped roof for the bin wherein the second portion has an upper edge with an elongated flange extending laterally away from the edge to nest inside a flange on the rafter.

2. A grain bin having a circular side wall with a plurality of parallel horizontal corrugations adjacent an upper edge, and a plurality of rafters extending upwardly and inwardly from the upper edge to support a conical shaped roof, and an attachment bracket securing the lower ends of at least some of the rafters to the upper edge of the side wall, the invention comprising, the attachment brackets each having first and second attachment portions at right angles to each other, the first portions having a plurality of parallel horizontal corrugations nesting in the parallel horizontal corrugations adjacent the upper portion of the bin wall, means for securing the first portion to the sidewall, the second portions extending upwardly and inwardly from the first portions, and means for connecting the second portions to the lower ends of the rafters.

3. The grain bin of claim 2 wherein the second portion has an upper edge with an elongated flange extending laterally away from the edge to nest inside a flange on the rafter.

* * * * *